United States Patent [19]

Vidal

[11] 3,981,038

[45] Sept. 21, 1976

[54] BRIDGE AND ABUTMENT THEREFOR

[76] Inventor: Henri C. Vidal, Tour Aurore - Cedex No. 5, 92080 Paris, France

[22] Filed: June 26, 1975

[21] Appl. No.: 590,729

[52] U.S. Cl. ..... 14/26; 52/293; 61/39

[51] Int. Cl.[2] ..... E02D 5/20

[58] Field of Search ..... 14/26, 75; 61/37, 39, 61/50, 52; 52/293

[56] References Cited

UNITED STATES PATENTS

| | | | |
|---|---|---|---|
| 440,437 | 11/1890 | Phillips | 14/75 X |
| 568,673 | 9/1896 | Geisel | 14/26 X |
| 1,215,537 | 2/1917 | Hyatt | 14/75 X |
| 1,306,725 | 6/1919 | Small | 14/75 |

*Primary Examiner*—Nile C. Byers, Jr.

*Attorney, Agent, or Firm*—Burns, Doane, Swecker & Mathis

[57] ABSTRACT

A bridge construction is disclosed in which the ends of a bridge deck are supported by an abutment comprising a mass of internally stabilized earth. A plurality of elongate reinforcing members are arranged in vertically spaced horizontal layers. Within each layer the members are spaced apart laterally and some of the members extend at right angles to other members to form a lattice. Particulate material is placed and compacted into a contiguous aggregate which fills the vertical array of horizontal lattices. The mass of internally stabilized earth is surrounded on three sides by non-load bearing walls constructed from a plurality of facing elements. A portion of the reinforcing members extending from one abutment side wall may be connected with corresponding reinforcing members extending from the other side wall to form a substantially continuous member therebetween. Corner blocks may be provided at the generally perpendicular corners between adjacent walls. Similarly, a monolithic beam seat or slab may be provided at the upper edge of each abutment such that it rests on the internally stabilized earth mass to support the end of the bridge deck.

16 Claims, 8 Drawing Figures

BRIDGE AND ABUTMENT THEREFOR

BACKGROUND OF THE INVENTION

This invention relates generally to bridges and abutments for use in conjunction therewith. More specifically, the invention relates to a bridge abutment in which the end of the bridge deck is directly supported by a mass of internally stabilized earth.

In the past, bridges spanning a distance between spaced apart bridge abutments have been constructed with load-bearing columns or generally vertical load-bearing walls which vertically support the weight of the bridge deck which extends between the spaced abutments. Typically, such abutments are fabricated from poured concrete and are supported by a suitable footer. Depending on soil characteristics and conditions, it is sometimes necessary to provide a plurality of generally vertical pilings which are driven into the ground to support the footers. Often, side walls or wing walls are provided for the bridge abutment and these walls are frequently fabricated from poured concrete.

The poured concrete method requires accurate placement and positioning of suitable forms to hold concrete while it cures and develops the necessary strength. Moreover, the poured concrete bridge abutments generally require a framework of reinforcing steel which must be assembled at the job site and properly positioned in the forms by workmen.

With abutments poured and cured, a bridge deck is placed spanning the distance between the spaced apart abutments. Concurrently or subsequently, an area defined between each abutment wall and the associated wing walls is filled with earth or other suitable aggregate and compacted to provide an approach to the bridge deck which conforms with the elevation existing at the end thereof.

There are other common bridge abutment constructions that utilize a combination of steel filings and concrete. These structures are complex and difficult to construct. Consequently, they are expensive.

Another design aspect relates to the physical dimensions of some bridge abutments. As the abutments become wider, it becomes necessary to form the bridge abutments in piecewise fashion to accommodate differential thermal expansion thereby introducing substantial time delays and substantially increasing the construction expense. Moreover, wide abutments are more susceptible to differential settling of horizontally spaced portions which settling may induce formation of cracks and other structural anomalies.

It is well known that the excavation and site preparation for a bridge abutment are both expensive and time consuming. In view of the above discussion, it should be apparent that the construction of footers and load-bearing walls is both very expensive and very time consuming.

OBJECTS AND SUMMARY OF THE INVENTION

It is a general object of the present invention to overcome disadvantages of existing construction methods such as those generally discussed above.

It is a more specific object of the present invention to provide a bridge abutment construction which requires less time to build, and which is less expensive to build than the conventional concrete structure.

A bridge structure which, in accordance with this invention, accomplishes at least some of the above objects, includes a deck spanning the distance between spaced-apart abutments. Each abutment comprises an anterior wall and a pair of side walls spaced apart from each other and extending rearwardly from the anterior wall, thereby defining a generally U-shaped structure. Each wall means is preferably composed of a plurality of facing elements. At least one elongate reinforcing member is attached to each facing element and extends therefrom into the space defined by the U-shaped structure. The reinforcing elements are arranged in vertical spaced generally horizontal layers and have interstices therebetween filled with particulate material such that a contiguous aggregate is formed.

At the intersecting edges of the walls suitable corner blocks may be provided which have elongate reinforcing members attached thereto and dowel pins for vertical alignment therebetween. The elongate reinforcing members supporting the corner blocks are preferably disposed in one of the generally horizontal layers.

The contiguous aggregate of particulate material is provided with a top surface adjacent the upper edge of the interior wall. On the top surface of the particulate material a suitable pillow block may be provided for direct support of an end of the bridge deck.

BRIEF DESCRIPTION OF THE DRAWINGS

A preferred embodiment of the invention is illustrated in the accompanying drawings wherein like reference numerals have been applied to like elements and wherein.

DESCRIPTION OF THE PREFERRED EMBODIMENT

Figure 1:
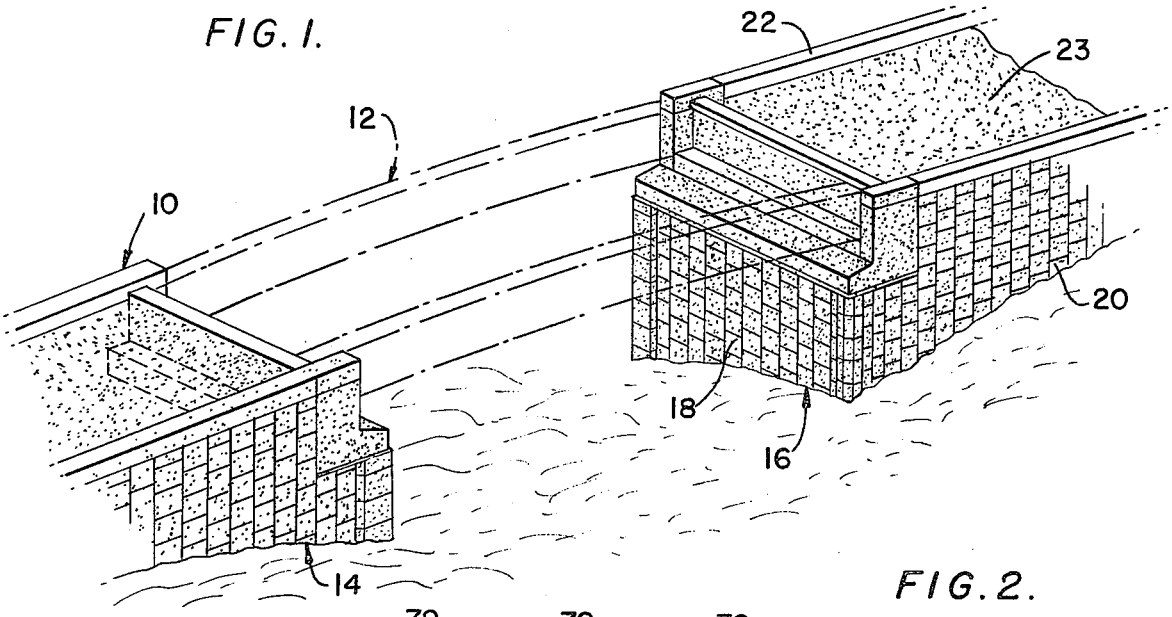
FIG. 1 is a perspective view of a bridge constructed in accordance with the present invention with the bridge deck shown in phantom lines for the sake of clarity.

Illustrated in FIG. 1 is a bridge 10 comprising a deck 12 which is illustrated in phantom lines and which is supported at each end by an abutment 14, 16. As the abutments 14, 16 may be constructed in similar manner, the details of abutment 16 will be described with the understanding that abutment 14 is preferably provided with similar features. It will be apparent to those skilled in the art, however, that one abutment might be fabricated in accordance with conventional techniques without departing from the scope of this invention.

The abutment 16 includes an anterior wall 18 and a pair of wing walls, or side walls, 20, 22. The side walls 20, 22 in combination with the anterior wall 18 comprise a generally U-shaped structure having a space 23 defined thereby. Preferably, the side walls 20, 22 are parallel to one another and perpendicular to the anterior wall 18. Of course, in some situations, the side walls may be in the nature of wing walls that slope outwardly at an angle greater than 90° from the anterior wall.

Figure 2:
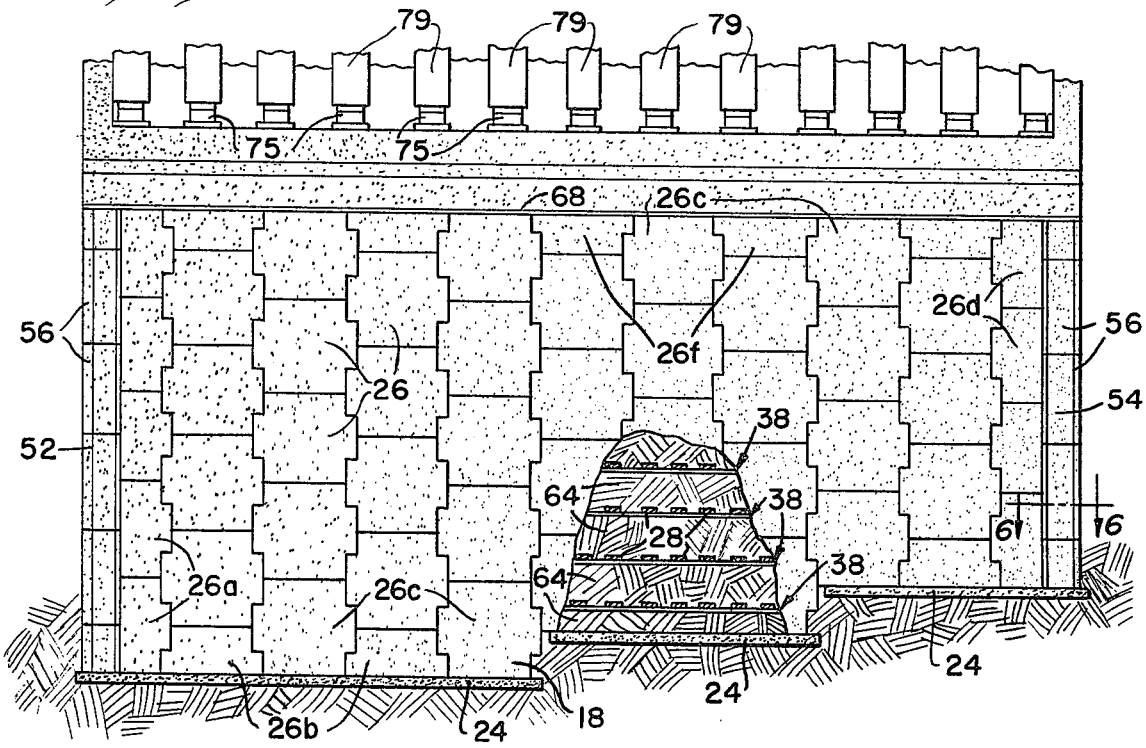
FIG. 2 is a partial elevational view of the bridge showing an anterior wall of one of the abutments and having a portion broken away to illustrate the vertical spacing of reinforcing elements connected to facing elements.

Turning now to FIG. 2, the anterior wall 18 is provided with one or more generally horizontal leveling pads 24 which serve the purpose of providing a level surface for construction of the wall 18. It should be noted that while the leveling pads 24 are generally horizontal in the illustration, the leveling pads may be inclined. Moreover, the leveling pads 24 are distinguished from conventional footers in that their function is to provide a base surface on which a wall is constructed. Footers, on the other hand, must provide a base surface and also support the wall and the force loads it transmits thus requiring a larger, heavier member and more expensive construction.

The wall 18 is composed of a plurality of interior facing elements 26 and peripheral facing elements, 26*a*, 26*b*, 26*c*, 26*d*, 26*e*, 26*f*. The interior facing elements 26 and the peripheral facing elements are arranged in columns which are generally perpendicular to the leveling pads 24 and which are offset relative to one another such that each interior facing element 26 is contiguously adjacent to six other facing elements.

Preferably, each facing element is precast concrete. Moreover, it is preferred that each interior facing element 26 conforms to the configuration described in detail by U.S. Pat. No. 3,686,873 which issued on Aug. 26, 1972 to Henri C. Vidal, which patent is expressly incorporated herein by reference thereto. Similarly, it is preferred that the peripheral facing blocks 26*a*, 26*b*, 26*c*, 26*d*, 26*e*, 26*f* be formed by dividing an interior facing block 26 in half either vertically or horizontally, as required. Conveniently, these peripheral blocks may be formed by walling off a particular part of the form used to cast the interior elements 26.

Where leveling pads 24 underlie portions of the anterior wall 18 at different elevations such as where the original ground surface is not level, the elevation between the adjacent leveling pads 24 is preferably selected to be one half the height of the typical interior facing element 26. In this manner, modular interior facing elements may be used and the required number of special and odd-sized peripheral facing elements is reduced.

As described in U.S. Pat. No. 3,686,873, each interior facing element 26 is provided with means for connection with six adjacent facing elements. In the preferred embodiment, this connection is effected by pins received by cylindrical apertures in the elements and interfitting flanges on the edges of the elements. Preferably, each facing element is also provided with one or more integrally cast lugs extending generally perpendicularly from a rear surface thereof to which elongate reinforcing members are attached. In the preferred embodiment, each facing element includes four or more lugs to which elongate reinforcing elements 28 are attached. The reinforcing elements 28 extend laterally in a direction opposite from the exterior face of the corresponding facing element and inwardly toward the area defined by the U-shaped structure.

In a completed structure the reinforcing members attached to the facing elements in combination with the pins connecting adjacent facing elements hold the facing elements vertical. The facing elements themselves support the weight of each other.

Figure 3:
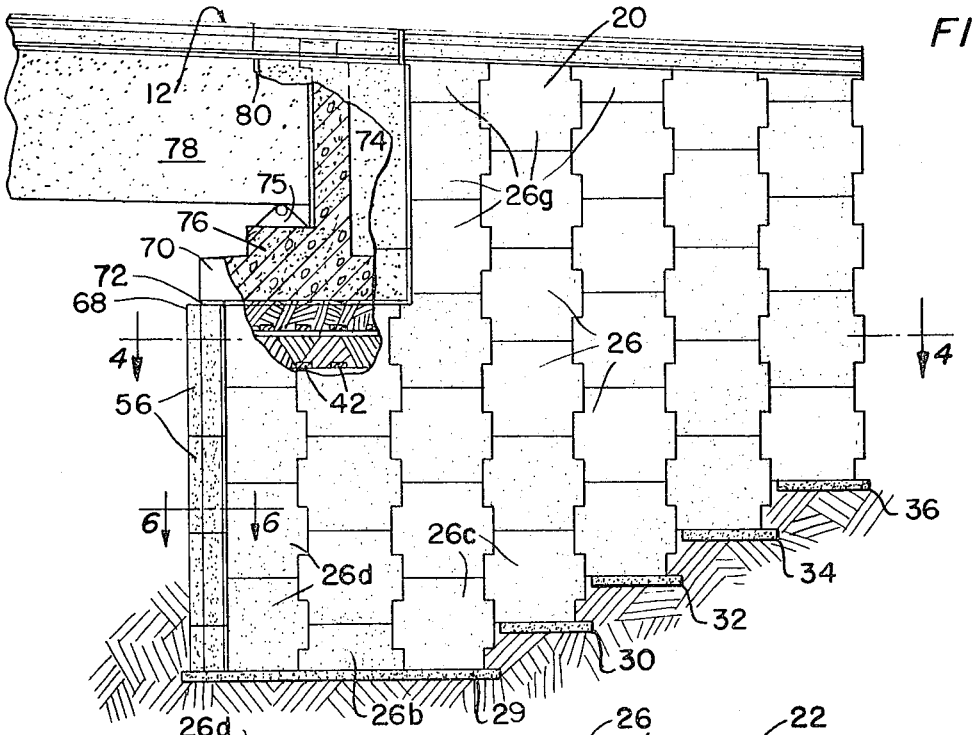
FIG. 3 is a partial elevational view of the bridge showing a side wall of the bridge abutment and having a portion partially broken away to illustrate the manner in which a bridge deck is supported.

Turning now to FIG. 3, details of the side wall 20 are illustrated which disclose that it is constructed from a plurality of facing elements 26 that are substantially the same as the elements comprising the anterior wall 18. As in the case of the anterior wall 18, the side wall 20 is provided with a leveling pad 29 and may include vertically spaced leveling pads 30, 32, 34, 36 that each partially underlie a corresponding portion of the wall. The vertically spaced leveling pads may have lengths approximately equal to an integral number times the width of a facing element 26. In addition, the piecewise arranged footers reduce the required number of facing elements by allowing the face of the wall to conform generally with existing ground surface slopes.

Peripheral facing elements 26*b*, 26*c*, 26*d*, and 26*g* are provided to obtain edges with proper orientation and elevation. These peripheral facing elements are fabricated as discussed above in connection with the anterior wall means 18.

As the wall 22 is constructed in a manner similar to the construction of wall 20, the details thereof will not be repeated with the understanding that wall 20 and wall 22 need not be geometrically congruent or geometrically similar.

Figure 4:
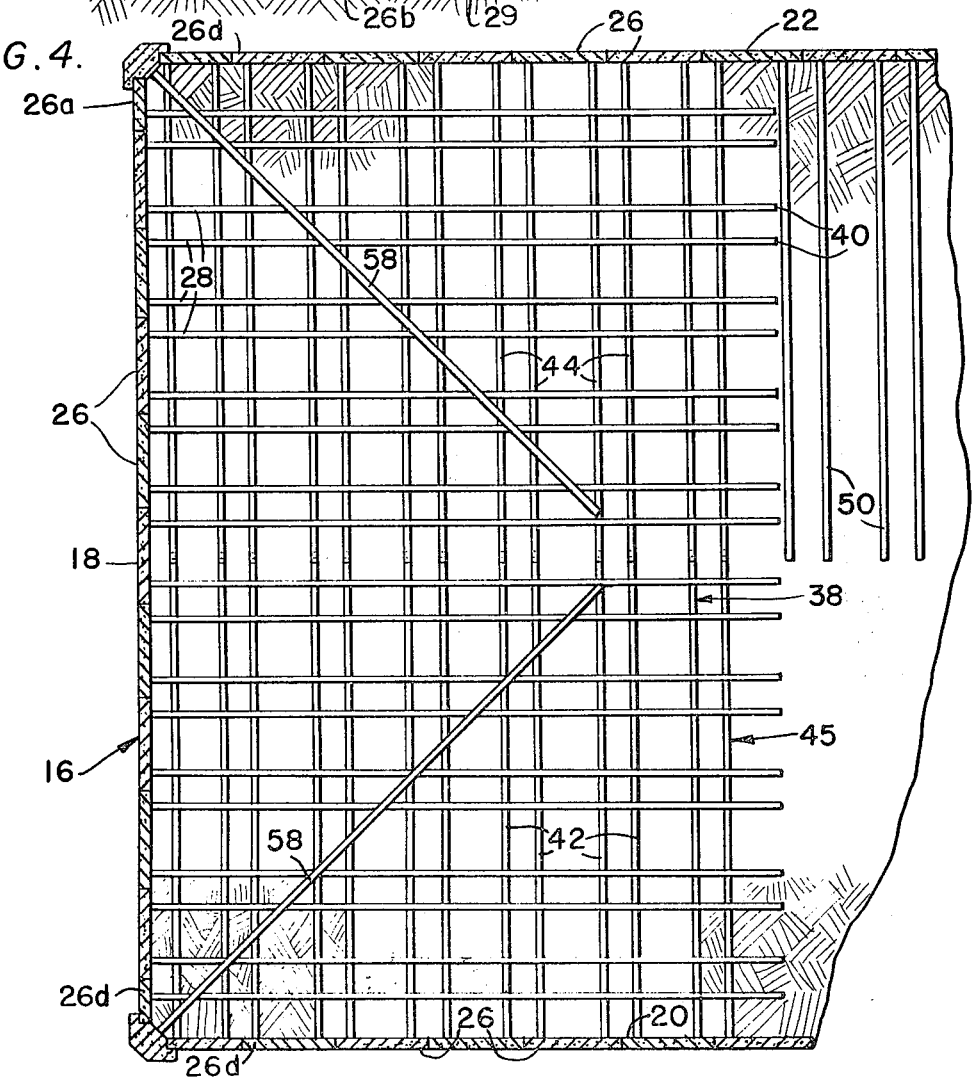
FIG. 4 is a cross-sectional view of the bridge abutment taken along line 4—4 of FIG. 2 and illustrating a generally horizontal layer of reinforcing elements.

Turning now to FIG. 4, a generally horizontal layer 38 is comprised of the elongate reinforcing members connected to each facing element 26. The elongate reinforcing elements 28 are connected to lugs of facing elements of the anterior wall 18 and extend inwardly to a free end 40.

Elongate reinforcing elements 42 extend inwardly from the facing elements of the side wall 20 and may be endwise connected to the elongate reinforcing elements 44 which extend inwardly from the facing elements of the wall 22, as illustrated. It will be noted that elongate reinforcing elements 28, 42, 44 overlap one another in generally perpendicular fashion to define a generally horizontal lattice 45 in the layer 38.

Figure 8:
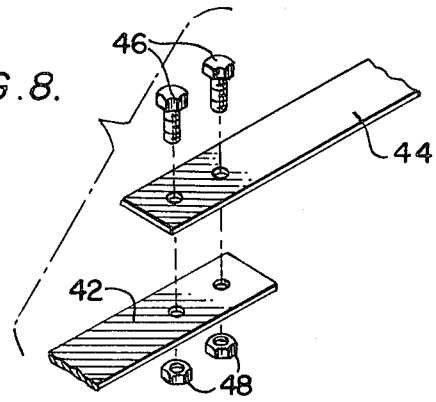
FIG. 8 is a partially exploded view illustrating the connection between reinforcing members.

With reference to FIG. 8, it will be apparent that the connection between the reinforcing member 42 and the reinforcing member 44 may be effected by suitable threaded connectors such as the illustrated bolts 46 and nuts 48. By connecting the elongate reinforcing members 42, 44 from the facing elements of the pair of side walls 20, 22, a substantially continuous reinforcing member is provided between the side walls 20, 22.

Returning to FIG. 4, a portion of the elongate reinforcing members 50 which project inwardly from side wall 22 are not connected with corresponding elongate reinforcing members from side wall 20. This illustrates an embodiment in which the side wall 20 is either shorter than or higher than the corresponding portion of side wall 22.

Figure 5:
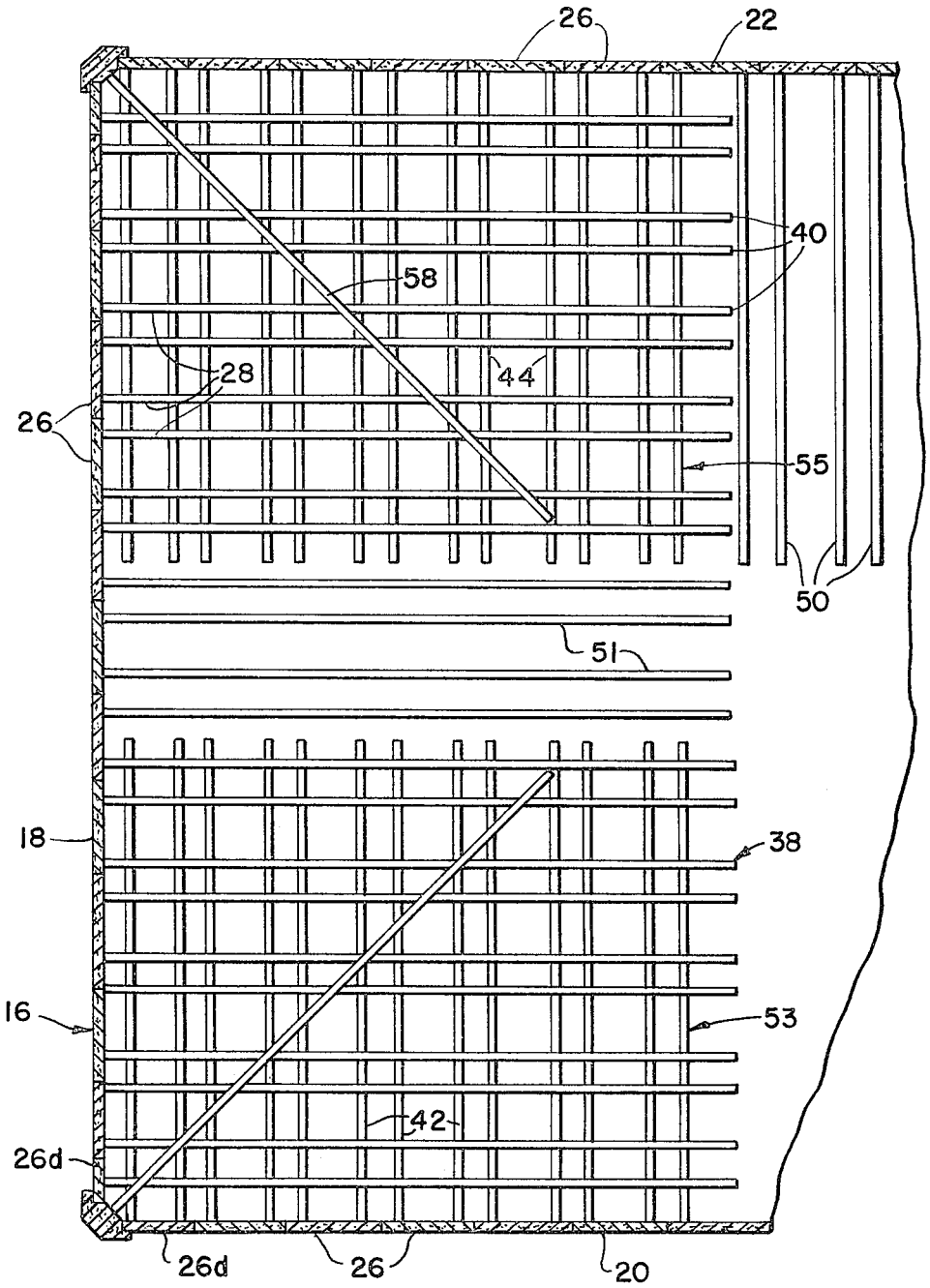
FIG. 5 is a cross-sectional view of the bridge abutment similar to FIG. 4, and illustrates the reinforcing element configuration for a relatively wide bridge abutment.

In FIG. 5, the side walls 20, 22 are spaced further apart than in the embodiment illustrated in FIG. 4. Accordingly, some reinforcing elements 51 are not overlapped by the reinforcing members 42, 44 extending from the sides 20, 22. Thus, two generally horizontal lattices 53, 55 are defined in each layer 38 with each lattice being adjacent a corresponding corner of the abutment 16.

Figure 6:
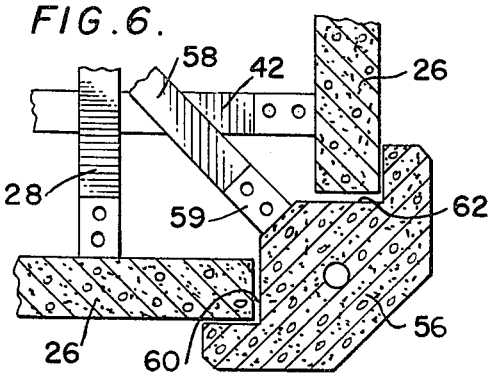
FIG. 6 is a detailed cross-sectional view taken along line 6—6 of FIG. 3 illustrating the relationship of a corner block with respect to the anterior wall and a side wall.

Disposed at the adjacent vertical edges of the anterior wall 18 and the side walls 20, 22 is a column 52, 54 (see FIG. 2) comprised of a plurality of corner blocks 56. As best shown by FIG. 6, each corner block 56 is provided with suitable notches 60, 62 that are adapted to receive adjacent edge portions of facing elements 26 such that the corner block 56 is in partially overlapping relationship therewith.

Moreover, each corner block 56 is provided with at least one lug 59 to which an elongate reinforcing member 58 is attached such that it is generally positioned in the plane of a lattice 38 (see FIG. 4). It will be noted that the elongate reinforcing member 58 from each corner block 56 extends inwardly with respect to the side walls 20, 22 and the anterior wall 18 and may overlie the lattice 38 at a corresponding elevation in the structure. It may be noted here that while the various reinforcing members overlap, there is no physical connection therebetween.

Figure 7:
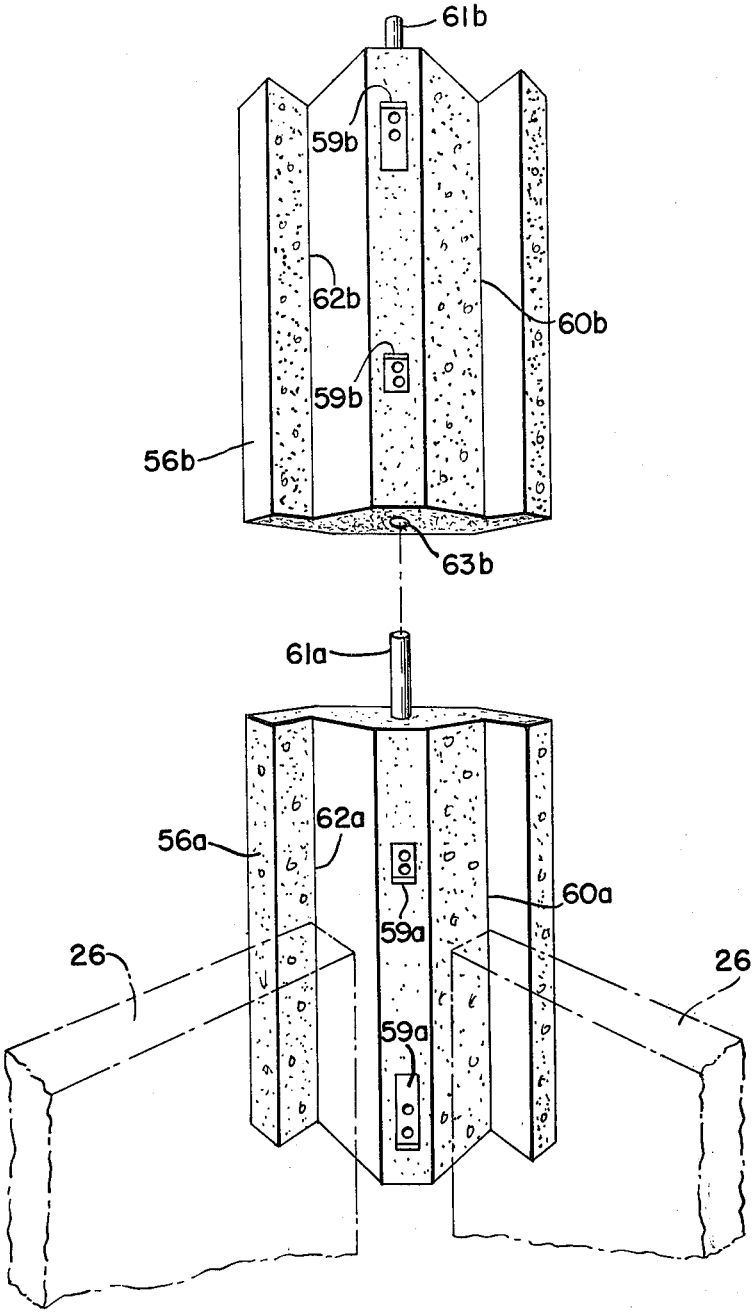
FIG. 7 is a perspective view of a pair of aligned corner blocks showing a projecting dowel and a corresponding dowel-receiving aperture.

Depicted in FIG. 7 are two corner blocks 56*a*, 56*b* with corresponding portions having the same reference numeral but designated with suffixes *a* and *b*, respectively. Each block is provided with a dowel 61 extending from one end with a dowel receiving aperture 63 in the other end. As the column of corner blocks is constructed, the dowel 61*a* is received by the aperture 63*b* to align adjacent blocks and to prevent lateral movement therebetween.

Two lugs 59*a* and 59*b* are provided on each corner block 56 for attachment to reinforcing members 58. Preferably, the lugs are provided at opposite ends of a single U-shaped bracket which is precast in the block 56.

Returning now to FIG. 2, the elongate reinforcing elements from the multiplicity of facing elements define vertically spaced layers 38. While the layers 38 need not be uniformly spaced, it is preferred that uniform spacing be provided such that the layers are spaced to maximize the vertical extend of fill layers 64.

To properly appreciate the present invention it will be informative to describe the manner in which an abutment is constructed before proceeding to the manner in which the bridge deck means may be supported by the abutment. Accordingly, it may be noted from FIG. 2 that a fill layer 64 is interposed between each generally horizontal layer 38 of the vertically spaced array of reinforcing elements.

During construction, the three walls, 18, 20, 22 are built in generally horizontal rows of facing elements. More specifically, a first course of facing elements is errected. Subsequently a first fill layer 64 is placed and compacted. Next, a first layer 38 of reinforcing members 28, 42, 44, 50, 51, 58 is positioned and attached to the facing elements. Then a second fill layer is placed and compacted and a second layer of reinforcing members is positioned and attached. Second and subsequent courses of facing elements are erected as needed.

The space between the walls 18, 20, 22 is thus filled with layers of reinforcing elements and fill layers 64 of particulate material until another row of elements need to be placed. In this manner, a contiguous aggregate of particulate material is formed which substantially fills the interstices between the reinforcing elements 28, 42, 44 and 58.

When the anterior wall 18 has reached the desired height, the particulate material is provided with a surface 66 (see FIG. 3) which is adjacent the top edge 68 of the anterior wall 18.

With the elongate reinforcing elements and the compacted earth positioned as described, a suitable beam seat 70, which may be fabricated as a monolithic piece of precast concrete, is rested in position on the surface 66 such that a space 72 is provided between the beam seat 70 and adjacent portions of the anterior wall 18, the corner blocks 56 and the side walls 20, 22. With the bearing seat 70 positioned, the remaining portions of the side walls 20, 22 which extend vertically upwardly above the top edge 78 of the anterior wall may be completed in the manner described above.

In cross section, the beam seat 70 is provided with a generally vertical portion 74 which functions in part as a retaining wall for particulate material adjacent thereto. The vertical portion 74 has a horizontal shoulder 76 on which conventional bearing blocks (not shown) or roller supports 75 are disposed to support an end 78 of each beam 79 (see FIG. 2) of the bridge deck means 12. A space 80 is provided between the beam end 78 and the vertically upstanding portions 74. The bridge deck means 12 may be designed in any conventional manner.

Since the beam seat 70 is supported directly by the surface 66 of a column of internally stabilized earth which is circumscribed in part by the walls 18, 20, 22, the beam seat 70 need not overlap the top edges of the walls 18, 20, 22. In accordance with the present invention this part of a design is dictated by architectural considerations as distinguished from structural considerations. Accordingly, it will be noted that the walls 18, 20, 22 are non-load bearing in the sense that they support only their own weight and not the bridge deck means.

It should be noted that the particulate material which is used to fill the area between the walls 18, 20, 22 may be naturally occurring material such as sand, stone, earth, or other similar aggregate. Moreover, it is also possible to use such materials as crushed stone and other processed materials which are either non-naturally occurring or processed in some suitable manner.

It should now be apparent that there has been provided in accordance with the present invention a generally vertical mass of internally stabilized earth on which the bridge deck is directly supported such that the walls 18, 20, 22 defining the column of reinforced earth are non-load bearing.

It will, moreover, be apparent to those skilled in the art that many modifications, variations, substitutions and equivalents may be used in lieu of the elements described. It is therefore expressly intended that all such modifications, variations, substitutions and equivalents which lie within the spirit and scope of the invention as defined in the appended claims be encompassed thereby.

What is claimed is:

1. In a bridge having deck means spanning a distance between spaced-apart abutment means, an improved abutment means providing vertical support to an end of the deck means, comprising:

anterior wall means having an exterior surface, a top edge, generally vertical spaced-apart side edges, and being assembled from a plurality of facing elements;

a pair of side wall means, each side wall means disposed adjacent a corresponding side edge of the anterior wall means, having an exterior surface, and being assembled from a plurality of facing elements;

a plurality of elongate reinforcing members, at least one of said members being attached to each facing element, said members extending away from the exterior surface associated with the corresponding facing element, the elongate reinforcing members being arranged to define a plurality of generally horizontal layers that are spaced apart vertically from each other;

particulate material disposed between the side wall means and adjacent the anterior wall means and forming a contiguous aggregate filling the spaces between said layers and between laterally spaced members in said layers, the contiguous aggregate extending vertically above the top edge of the anterior wall means and having an upper surface; and beam seat means for supporting an end of the deck means, said beam seat means being superimposed on the upper surface of the contiguous aggregate and spaced from said wall means, whereby the wall means support only their own weight and the particulate material bears the weight of the end of the deck means.

2. The bridge of claim 1 including a plurality of corner blocks disposed in a vertical column overlapping a side edge of the anterior wall means and an adjacent portion of a side wall means, each corner block having a reinforcing member attached thereto and disposed in one of the horizontal lattices.

3. The bridge of claim 1 wherein the pair of side wall means are generally parallel and at least a portion of the elongate reinforcing members that are attached to one of said side wall means are also attached to the other of said side wall means to define a plurality of substantially continuous members extending between said side wall means.

4. The bridge of claim 3 wherein each layer of reinforcing members includes a lattice of overlapping reinforcing members disposed adjacent a corner of the abutment means.

5. The bridge of claim 3 including a plurality of corner blocks disposed in a vertical column overlapping a side edge of the anterior wall means and an adjacent portion of a side wall means, each corner block having a reinforcing member attached thereto and disposed in one of the horizontal lattices.

6. The bridge of claim 1 wherein each facing element is fabricated from concrete and each interior facing element includes means adaptable for connection with six adjacent facing elements.

7. The bridge of claim 1 wherein the beam seat means comprises a monolithic concrete member.

8. The bridge of claim 1 wherein the particulate material comprises naturally occurring material such as stone, sand, earth and the like.

9. A bridge for spanning a distance between spaced apart locations on a surface with an elevated structure, comprising:

deck means for spanning the distance; and abutment means provided at each spaced apart location, operable to support a corresponding end of the deck means, at least one of said abutment means including, anterior wall means having an exterior surface, a top edge, generally vertical spaced apart side edges, and being assembled from a plurality of facing elements, a pair of side wall means, each side wall means disposed adjacent a corresponding side edge of the anterior wall means, having an exterior surface, and being assembled from a plurality of facing elements, a plurality of elongate reinforcing members, at least one of said members being attached to each facing element, said members extending away from the exterior surface associated with the corresponding facing element, the elongate reinforcing members being arranged to define a plurality of generally horizontal layers that are spaced apart vertically from each other;

particulate material disposed between the side wall means and adjacent the anterior wall means and forming a contiguous aggregate filling the spaces between said layers and between laterally spaced members in said layers, the contiguous aggregate extending vertically above the top edge of the anterior wall means and having an upper surface; and beam seat means on which an end of the deck means rests, said beam seat being supported by the upper surface of the contiguous aggregate in vertically spaced relation to the top edge of the anterior wall means.

10. The bridge of claim 9 wherein each side edge of the anterior wall means is provided with an overlapping column of corner blocks, each corner block having a reinforcing member attached thereto and disposed in one of the horizontal lattices.

11. The bridge of claim 9 wherein the pair of side wall means are generally parallel and at least a portion of the elongate reinforcing members that are attached to one of said side wall means are also attached to the other of said side wall means to define a plurality of substantially continuous members extending between said side wall means.

12. The bridge of claim 9 wherein each facing element is fabricated from concrete, the anterior wall wall means and each side wall means include peripheral facing elements and interior facing elements, and each interior facing element includes means adaptable for connection with six adjacent facing elements.

13. An abutment for supporting an end of a structure such as a bridge in vertical spaced relationship to a surface comprising:

a generally vertical column of internally stabilized particulate material having at least three external walls, each wall including a plurality of reinforcing members each being imbedded in particulate material, and a plurality of facing elements, each facing element having at least one reinforcing member attached thereto; and beam seat means having a cross-sectional configuration with a generally horizontal portion, a generally vertical portion and a generally horizontal shoulder, being monolithically precast from concrete, being substantially coextensive with the abutment, and being supported by the column of internally stabilized particulate material.

14. The abutment of claim 13 wherein the column of particulate material extends above the horizontal portion of the beam seat means such that the vertical portion of the beam seat means functions in part as a retaining wall.

15. The abutment of claim 13 wherein a column of corner blocks is disposed at the intersection between two walls.

16. The abutment of claim 15 wherein each corner block includes a dowel pin extending from one end and a dowel-receiving aperture in the second end, the dowel-receiving aperture being operable to receive a dowel pin of an adjacent block thereby aligning each corner block with an adjacent corner block.

* * * * *